US009459040B2

(12) United States Patent
Kim et al.

(10) Patent No.: US 9,459,040 B2
(45) Date of Patent: Oct. 4, 2016

(54) REFRIGERATOR

(71) Applicant: SAMSUNG ELECTRONICS CO., LTD., Suwon-si, Gyeonggi-do (KR)

(72) Inventors: Hyun Soo Kim, Gwangmyeong-si (KR); Se Youn Park, Seoul (KR); Young Min Park, Seoul (KR); Min Hyoug Boo, Seoul (KR); Jong-Hyub Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/641,842

(22) Filed: Mar. 9, 2015

(65) Prior Publication Data

US 2015/0253064 A1 Sep. 10, 2015

(30) Foreign Application Priority Data

Mar. 10, 2014 (KR) ..... 10-2014-0027981

(51) Int. Cl.

| | |
|---|---|
| ***F25D 25/02*** | (2006.01) |
| ***F25D 23/06*** | (2006.01) |
| ***A47B 96/02*** | (2006.01) |
| ***A47B 97/06*** | (2006.01) |
| *A47B 96/06* | (2006.01) |

(52) U.S. Cl.

CPC ..... *F25D 25/02* (2013.01); *F25D 25/024* (2013.01); *A47B 96/02* (2013.01); *A47B 96/06* (2013.01); *F25D 23/067* (2013.01)

(58) Field of Classification Search

CPC ..... F25D 25/00; F25D 25/005; F25D 25/02; F25D 25/021; F25D 25/022; F25D 25/024; F25D 25/025; F25D 23/065; F25D 23/067; F25D 23/069; F25D 2325/00; A47B 88/0407; A47B 88/0418; A47B 88/0422; A47B 88/0429; A47B 88/044; A47B 96/02; A47B 96/021; A47B 96/024; A47B 96/027; A47B 96/028; A47B 96/06; A47B 96/061; A47B 96/062; A47B 96/067; A47B 96/07; A47B 2210/17; A47B 2210/175; A47B 2210/0047; A47B 95/02; A47B 2095/021; A47B 2095/022; A47B 2095/024; A47B 2095/026

See application file for complete search history.

(56) References Cited

U.S. PATENT DOCUMENTS

| | | | | | |
|---|---|---|---|---|---|
| 2,115,321 | A * | 4/1938 | Schweller | ..... | 108/62 |
| 2,292,865 | A * | 8/1942 | Boddy | ..... | 312/293.2 |
| 2,611,675 | A * | 9/1952 | Palmer | ..... | 312/351 |
| 2,825,617 | A * | 3/1958 | Morgan | ..... | 312/351 |
| 5,813,741 | A * | 9/1998 | Fish et al. | ..... | 312/408 |
| 5,918,959 | A * | 7/1999 | Lee | ..... | 312/404 |
| 8,398,187 | B2 * | 3/2013 | Benz et al. | ..... | 312/408 |

(Continued)

FOREIGN PATENT DOCUMENTS

| | | | | |
|---|---|---|---|---|
| DE | 202006014616 | * 3/2008 | ..... | F25D 25/00 |
| DE | 102011006959 | * 10/2012 | ..... | F25D 25/02 |

(Continued)

*Primary Examiner* — Andrew Roersma

(74) *Attorney, Agent, or Firm* — Staas & Halsey LLP

(57) ABSTRACT

Disclosed herein is a refrigerator includes a center frame provided to be spaced apart from the both walls of the body. The center frame includes a rear coupling unit coupling to the rear wall of the body, an arm unit extended forward from the rear coupling unit. The center frame may support at least two shelves disposed in a left side and a right side in the body so that the center frame supports moving of one or a combination of the shelves forward and backward with respect to the body.

14 Claims, 16 Drawing Sheets

(56) References Cited

U.S. PATENT DOCUMENTS

| | | | | |
|---|---|---|---|---|
| 2007/0018548 | A1* | 1/2007 | Ertz et al. | 312/402 |
| 2008/0265734 | A1* | 10/2008 | Hecht et al. | 312/408 |
| 2009/0121599 | A1* | 5/2009 | Laible | 312/404 |
| 2013/0106274 | A1* | 5/2013 | Yang | 312/404 |
| 2013/0219946 | A1* | 8/2013 | Sahasrabudhe et al. | 62/340 |
| 2014/0265807 | A1* | 9/2014 | Kendall et al. | 312/408 |

FOREIGN PATENT DOCUMENTS

| | | | | | |
|---|---|---|---|---|---|
| JP | 04165286 | A | * | 6/1992 | F25D 27/00 |
| JP | 09280728 | A | * | 10/1997 | F25D 25/02 |
| JP | 2008267619 | A | * | 11/2008 | F25D 23/00 |
| KR | 1020150003633 | A | * | 1/2015 | F25D 25/00 |
| WO | WO 2012028546 | A2 | * | 3/2012 | F25D 25/02 |

* cited by examiner

REFRIGERATOR

CROSS-REFERENCE TO RELATED APPLICATION(S)

This application claims the benefit of Korean Patent Application No. 2014-0027981, filed on Mar. 10, 2014 in the Korean Intellectual Property Office, the disclosure of which is incorporated herein by reference.

BACKGROUND

1. Field

Embodiments of the present disclosure relate to a refrigerator having a center frame provided on the center of a storage compartment to support a shelf.

2. Description of Related Art

In general, a refrigerator is an apparatus configured to keep foods fresh by having a body and a storage compartment provided inside the body, and a cool air supplying apparatus to supply cool air to the storage compartment.

In the storage compartment, shelves are provided to put on food. In general, as for French Door Refrigerator (FDR) provided with a storage compartment having spacious right and left space, the right side and left side of the storage compartment have separate shelf, respectively, and the shelf is supported by a rear wall of a body.

The shelf supported by only a rear wall of a body is referred as "cantilever rack". The cantilever rack is provided with hooks at the rear thereof and loops coupled to the hook disposed in a vertical direction with different height at a rear wall of a body. Therefore, the hook is coupled to the certain loop so that the height of the cantilever rack may be manipulated.

The cantilever rack may be fixed to the rear wall by the hook being coupled to the loop, and may be completely removed from the storage compartment by separating the hook from the loop. However, the cantilever rack may not be moved in forward and backward.

SUMMARY

Therefore, it is an aspect of the present disclosure to provide a refrigerator in which shelves are provided in a left side and a right side of a storage compartment, capable of moving a left shelf and a right shelf in forward and backward.

Additional aspects of the present disclosure will be set forth in part in the description which follows and, in part, will be obvious from the description, or may be learned by practice of the invention.

In accordance with one aspect of the present disclosure a refrigerator includes a body, a storage compartment formed inside the body, a shelf provided in the storage compartment, and a center frame provided in the middle of the storage compartment to be spaced apart from the both walls of the body. The center frame may include a rear coupling unit coupling to the rear wall of the body, a plurality of arm units extended forward from the rear coupling unit and vertically spaced apart from to each other with a certain distance to support the shelf, and a vertical reinforcement connecting the plurality of arm units to reinforce the strength of the plurality of arm units.

The arm unit may include an angled reinforcement having a height thereof being increased as the angled reinforcement goes from the front to the back to reinforce the strength of the plurality of arm units The rear coupling unit may include an adhesive support surface adhering to an inner surface of the rear wall of the body to strengthen the coherence between the center support frame and the rear wall of the body.

The center support frame may further include at least one locking protrusion protruding to be coupled to the rear wall of the body.

The body may include at least one locking groove formed on the rear wall of the body to allow the at least one locking protrusion to be inserted into.

At least one of the at least one locking protrusion may be formed in a shape of a hook.

The refrigerator may further include a rail assembly provided on the arm unit to movably support the shelf.

The rail assembly may include a fixed rail fixed to the arm unit, and a moving rail movably coupled to the fixed rail to support the shelf.

The moving rail may include a shelf support surface supporting the shelf, and an interlocking protrusion protruding to interlock the shelf.

The shelf may include an interlocking groove in conjunction with the interlocking protrusion.

The refrigerator may further include a handle assembly movably installed on the arm unit to allow the shelf to be withdrawn from and inserted into.

The handle assembly may include a handle body installed to be movable along the arm unit, and a connection device connecting the handle body to the moving rail of the rail assembly.

The connection device may include a rotation member rotatably provided on the handle body, a manipulation member rotating the rotation member, and a connection member coupled to the rotation member for the linear motion thereof in conjunction with the rotary motion of the rotation member and connected or disconnected to the moving rail of the rail assembly.

The handle assembly may further include a fixing protrusion movably installed on the manipulation member to fix the position of the rotation member, a fixing member provided with at least one fixing groove into which the fixing protrusion is inserted, and an elastic member elastically supporting the fixing protrusion toward the at least one fixing groove.

The moving rail of the rail assembly may include a connecting ring in which the connection device is inserted into and connected.

In accordance with another aspect of the present disclosure a refrigerator includes a body, a storage compartment formed inside the body, a first rail assembly provided on a left side wall of the body, a second rail assembly and a third rail assembly provided in the middle of the storage compartment to be spaced apart from the both walls of the body, a fourth rail assembly provided on a right side wall of the body, a first shelf movably supported by the first and the second rail assembly, and a second shelf movably supported by the third and the fourth rail assembly.

The refrigerator may further include a center frame supporting the second and the third rail assembly.

In accordance with another aspect of the present disclosure a refrigerator includes a body, a storage compartment formed inside the body, a shelf provided in the storage compartment, and a center shelf support unit provided in the middle of the storage compartment to be spaced apart from the both walls of the body. The center shelf support unit may include a rail assembly movably supporting the shelf and an arm unit supporting the rail assembly.

The center shelf support unit may further include a handle assembly movably installed on the arm unit to allow the shelf to be withdrawn from and inserted into.

The rail assembly may include a fixed rail fixed to the arm unit, and a moving rail movably coupled to the fixed rail to support the shelf, wherein the handle assembly is connected to the moving rail.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Reference will now be made in detail to embodiments of the present disclosure, examples of which are illustrated in the accompanying drawings.

Figure 1:
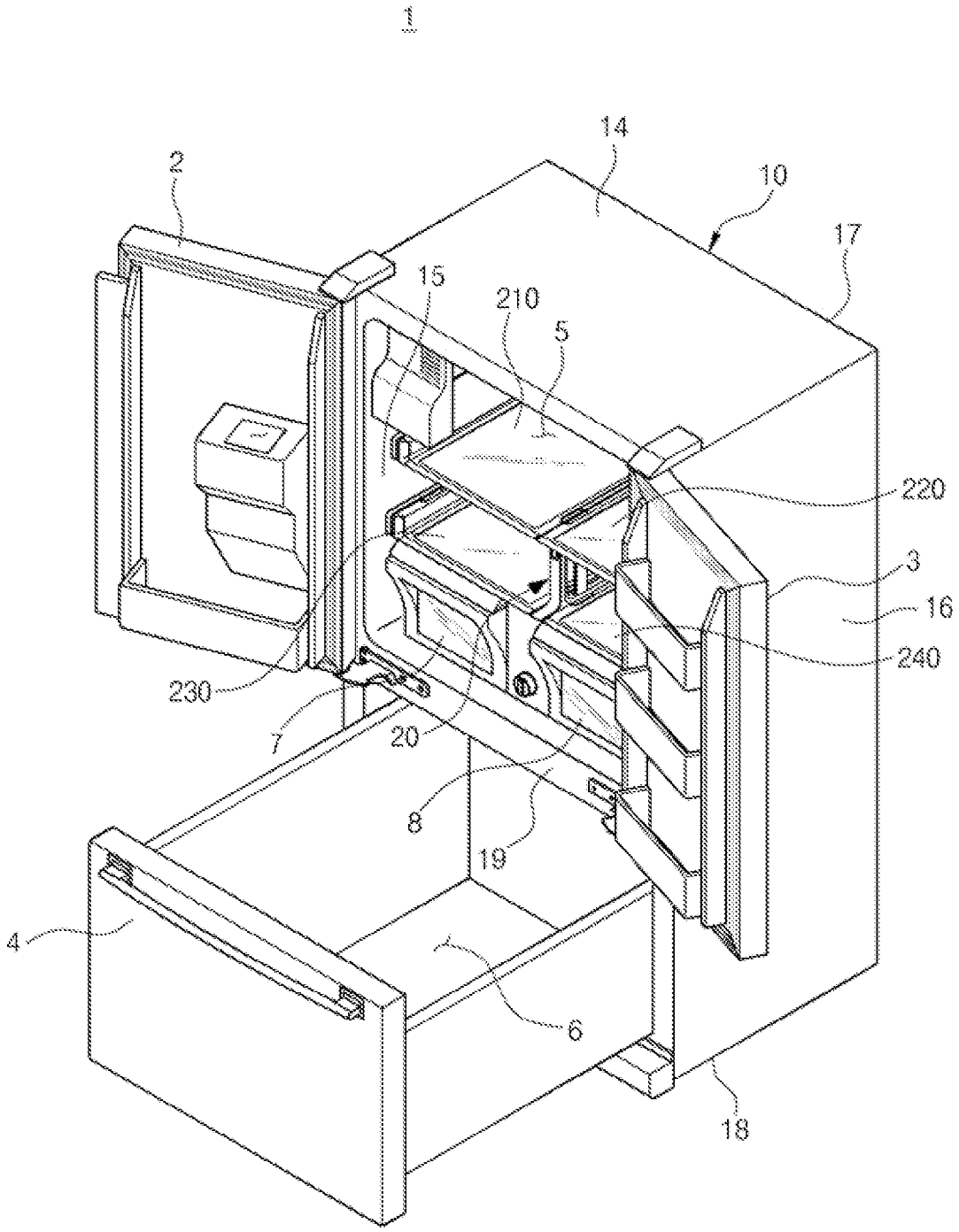
FIG. 1 is a view illustrating an external appearance of a refrigerator in accordance with one embodiment of the present disclosure.

FIG. 1 is a view illustrating an external appearance of a refrigerator in accordance with one embodiment of the present disclosure.

Referring to FIG. 1, a refrigerator 1, according to one embodiment of the present disclosure, may include a body 10, storage compartments 5 and 6 formed inside the body 10, and a cool air supply apparatus (not shown) for supplying cool air to the storage compartments 5 and 6.

The body 10 may be formed in a shape of a box having the front opened. The body 10 may include an inner case 11 (refer to FIG. 5) forming the storage compartment 5 and 6, an outer case forming an external appearance by coupling to the outside of the inner case, and insulation material 12 (refer to FIG. 5) provided between the inner case and the outer case.

The body 10 may include an upper wall 14, a left side wall 15, a right side wall 16, a rear wall 17, a bottom 18, and a horizontal partition 19 separating the storage compartment 5 and 6.

The storage compartment 5 and 6 may be divided into a refrigerating compartment 5 at the upper side thereof and a freezing compartment 6 at the lower side thereof by the horizontal partition 19. Each of the front surfaces of the refrigerating compartment 5 and the freezing compartment 6 may be opened so that food is put into or taken out of. The open surface may be opened/closed by doors 2, 3, and 4.

The refrigerating compartment 5 may be opened/closed by a plurality of doors 2 and 3 provided to be rotatable on the body 10. The freezing compartment 6 may be opened/closed by a sliding door 4 provided to be movably in forward and backward from the body 10.

The cool air supply apparatus (not shown) may include devices (not shown) for cooling cycle, a blowing fan (not shown) and the like. The cool air supply apparatus (not shown) may generate cool air and supply the cooling air to the refrigerating compartment 5 and the freezing compartment 6.

The refrigerating compartment 5 may be provided with shelves 210, 220, 230, and 240 where food is put on. The shelves 210, 220, 230, and 240 may include a first shelf 210 disposed on an upper left portion of the refrigerating compartment 5, a second shelf 220 disposed on upper right portion, a third shelf 230 disposed on a lower right portion, and a fourth shelf 240 disposed on a lower left portion.

The first shelf 210 and the second shelf 220 may be disposed on substantially the same level, and the third shelf 230 and the fourth shelf 240 may be disposed on substantially the same level.

At under the third shelf 230 and the fourth shelf 240, storage boxes 7 and 8 may be provided to storage food with sealing.

The shelves 210, 220, 230, and 240 of the refrigerator according to one embodiment of the present disclosure, may be provided to be movably in forward and backward. Therefore, users may draw the shelves 210, 220, 230, and 240 forward to put on or take out of food, and may insert the shelves 210, 220, 230, and 240 backward after putting on or taking out of food. For this reason, the convenience may be improved.

The reason of the shelves 210, 220, 230, and 240 according to one embodiment of the present disclosure, capable of moving forward and backward is that the shelves 210, 220, 230, and 240 are supported by a center shelf unit 20 disposed in a longitudinal direction at the middle of the refrigerating compartment 5.

Referentially, a conventional cantilever rack is mounted to or detached from a rear wall so that the cantilever rack cannot move forward and backward. Hereinafter, a configuration of a center shelf unit 20 will be described in accordance with one embodiment of the present disclosure.

Figure 2:
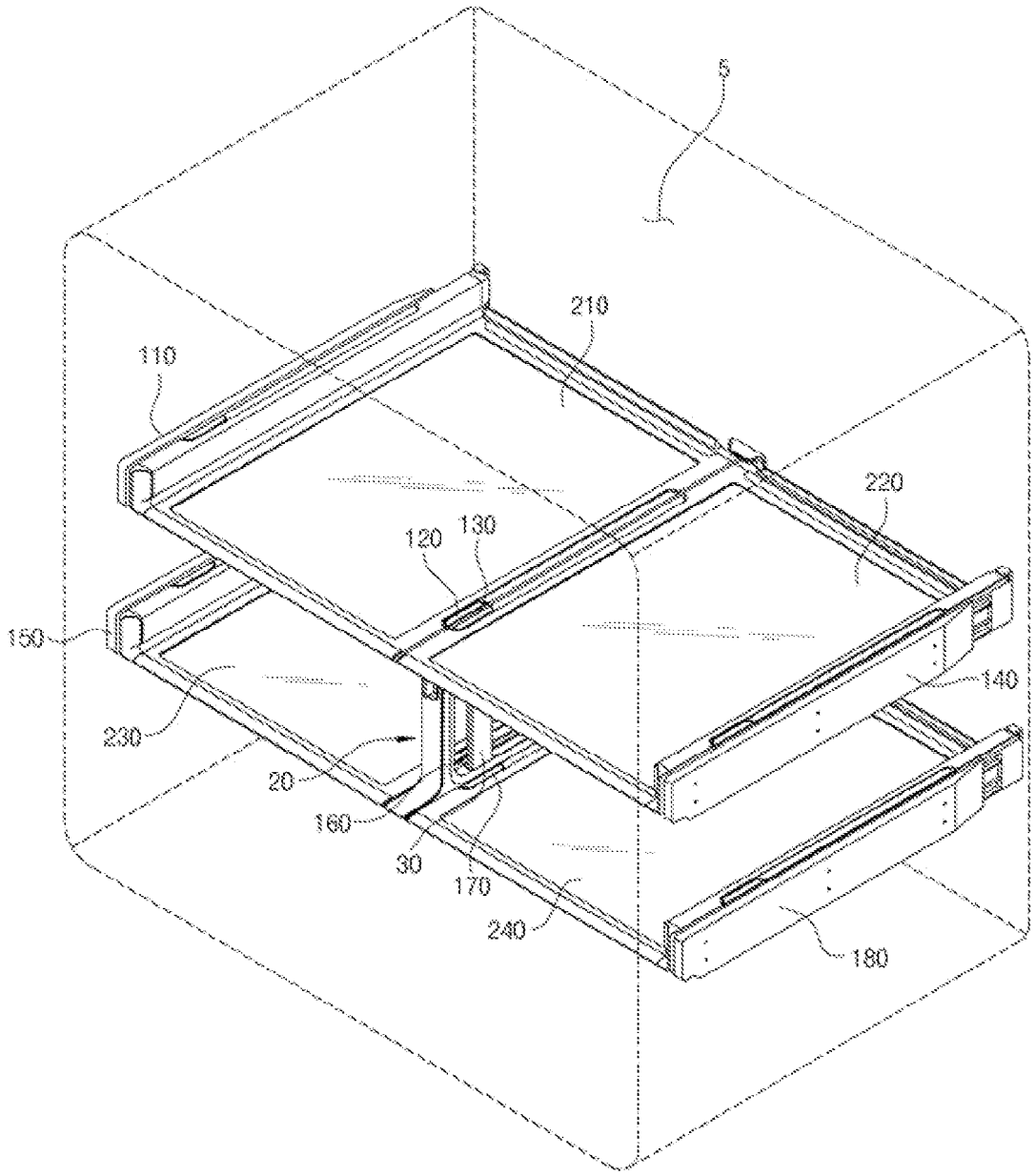
FIG. 2 is a view illustrating shelves, a left rail assembly and a right rail assembly for supporting the shelves, and a center shelf support unit in the refrigerator of FIG. 1
Figure 3:
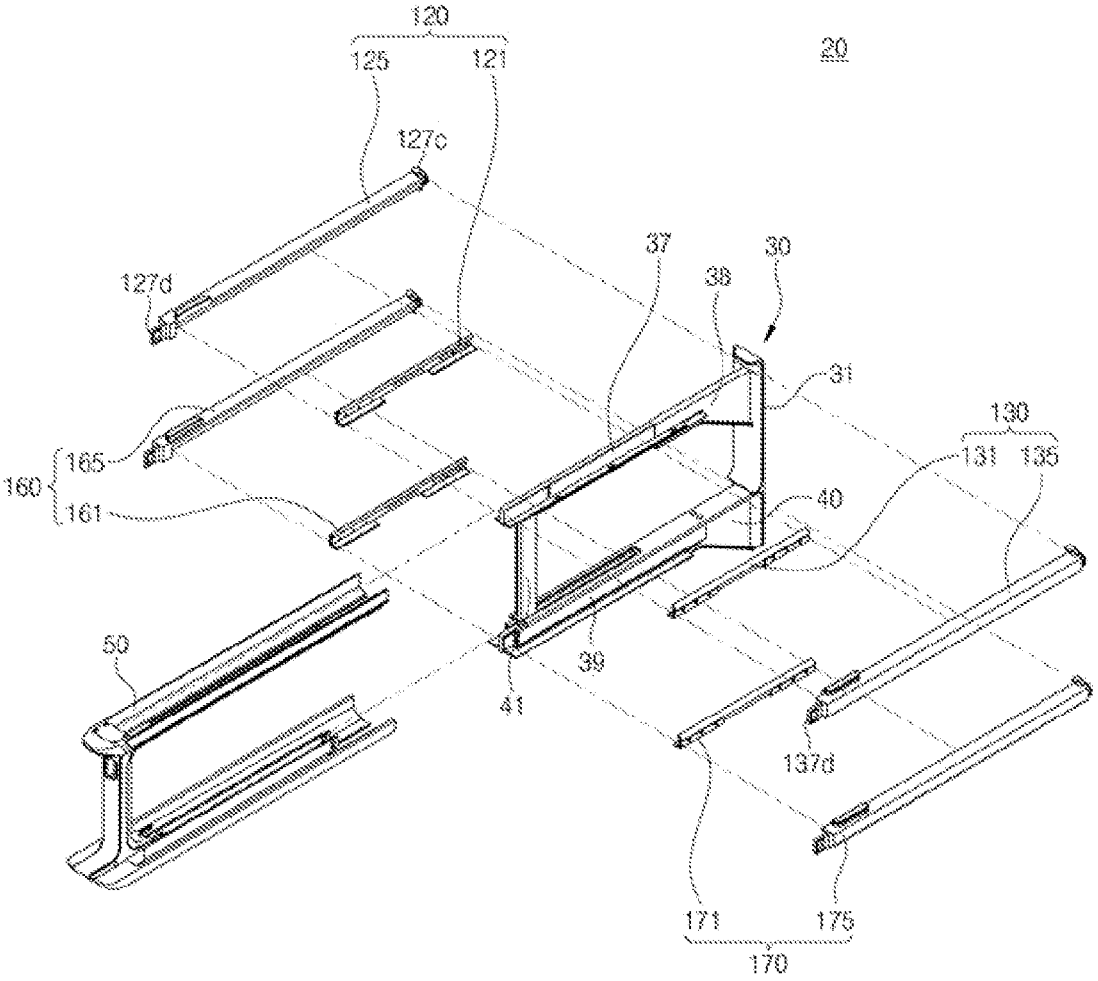
FIG. 3 is an exploded view illustrating the center shelf support unit of the refrigerator of FIG. 1.
Figure 4:
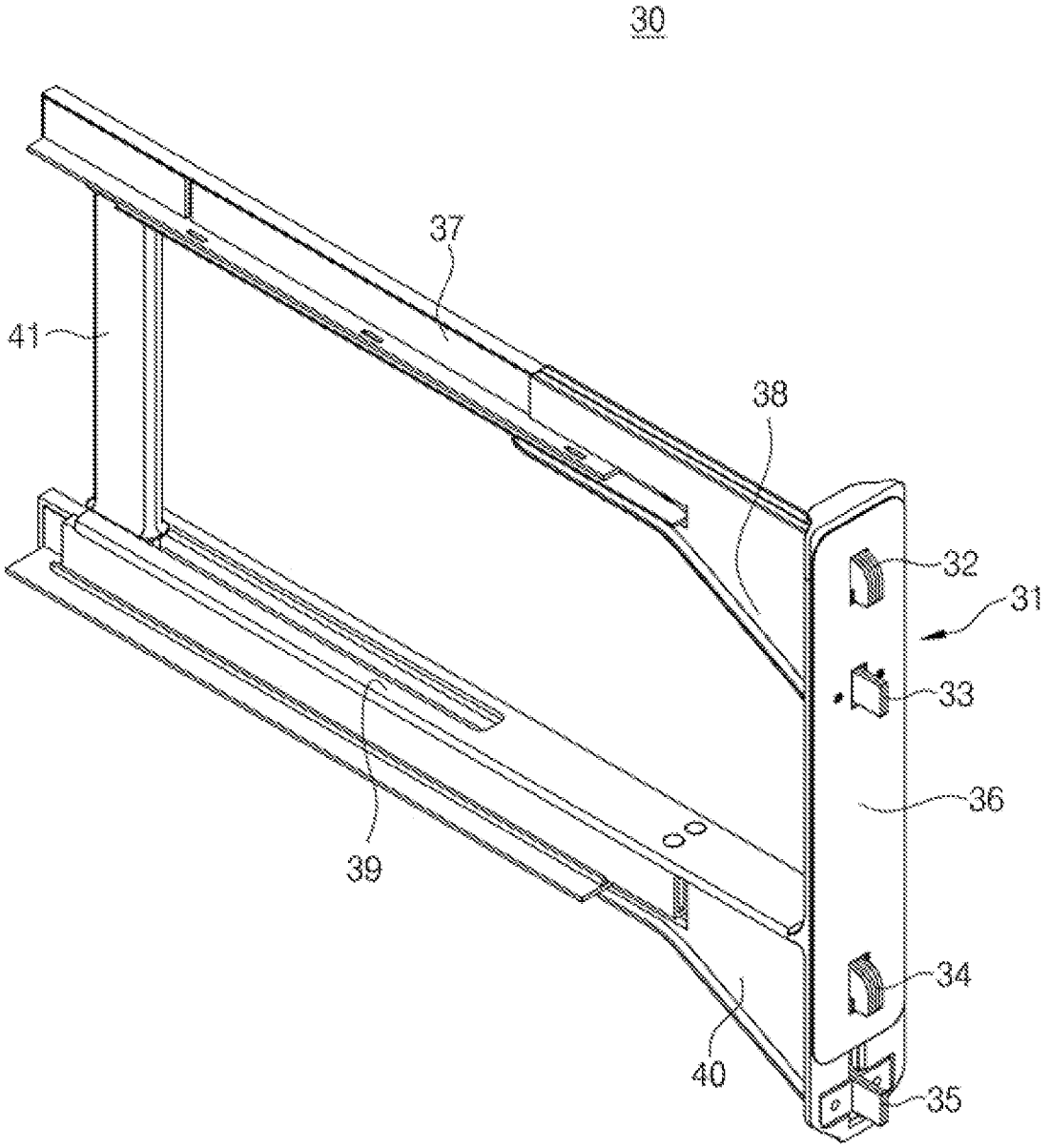
FIG. 4 is a back perspective view illustrating a center support frame of the refrigerator of FIG. 1.
Figure 5:
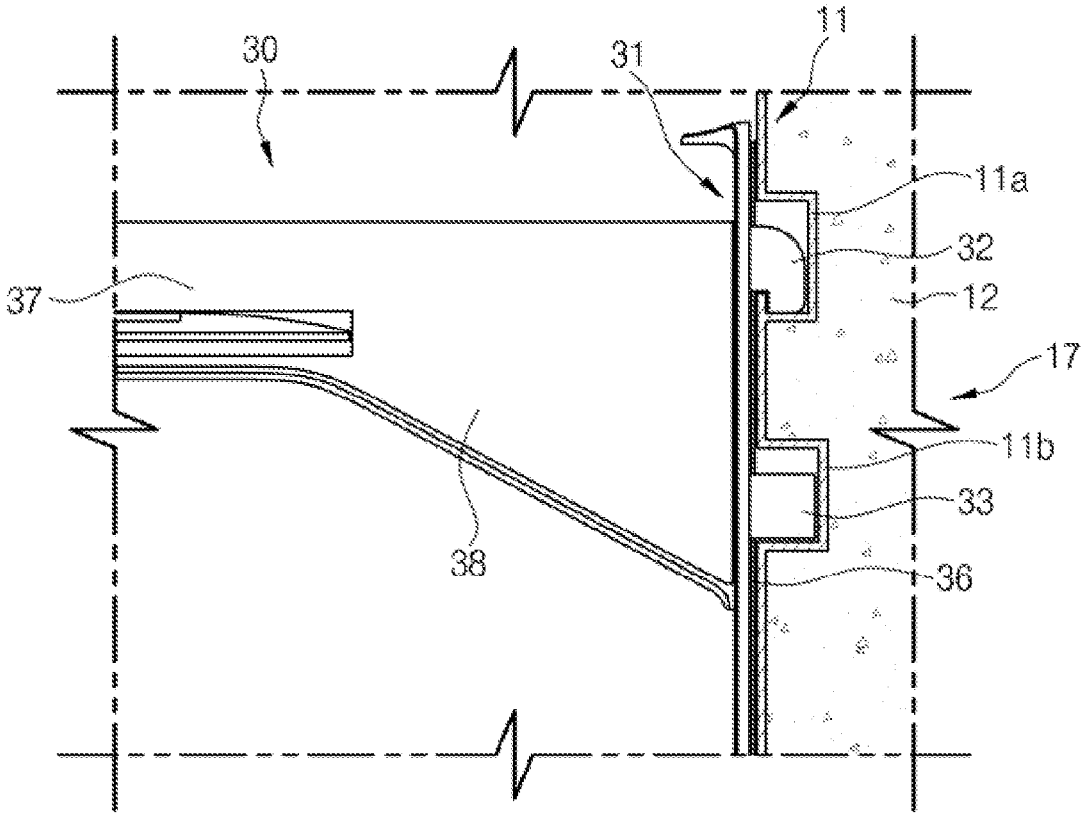
FIG. 5 is a cross-sectional view illustrating a configuration in which the center support frame of the refrigerator of FIG. 1 is coupled to a rear wall of a body.
Figure 6:
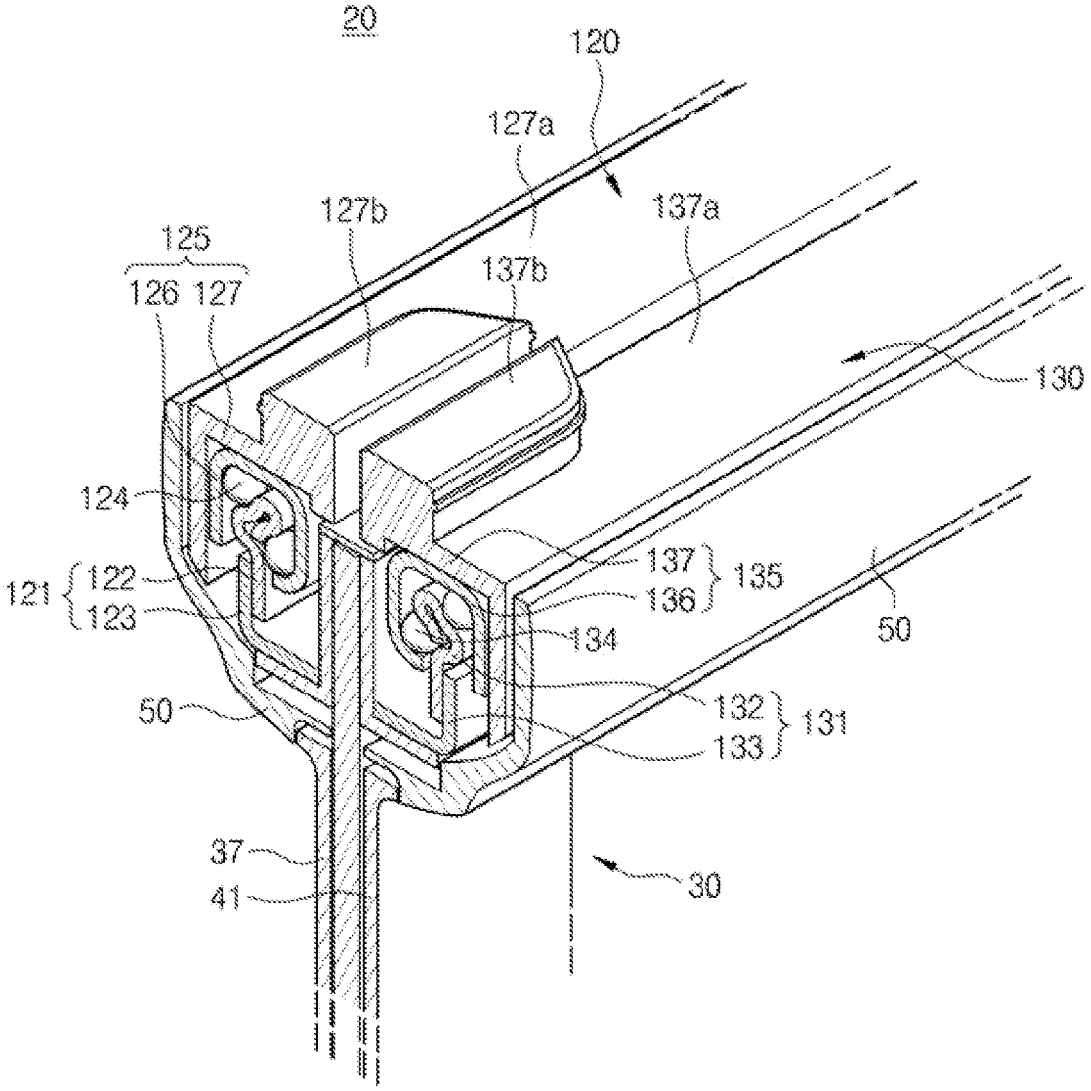
FIG. 6 is a cross-sectional view illustrating a connection structure of the center support frame of the refrigerator of FIG. 1, a rail assembly, and a handle assembly.
Figure 7:
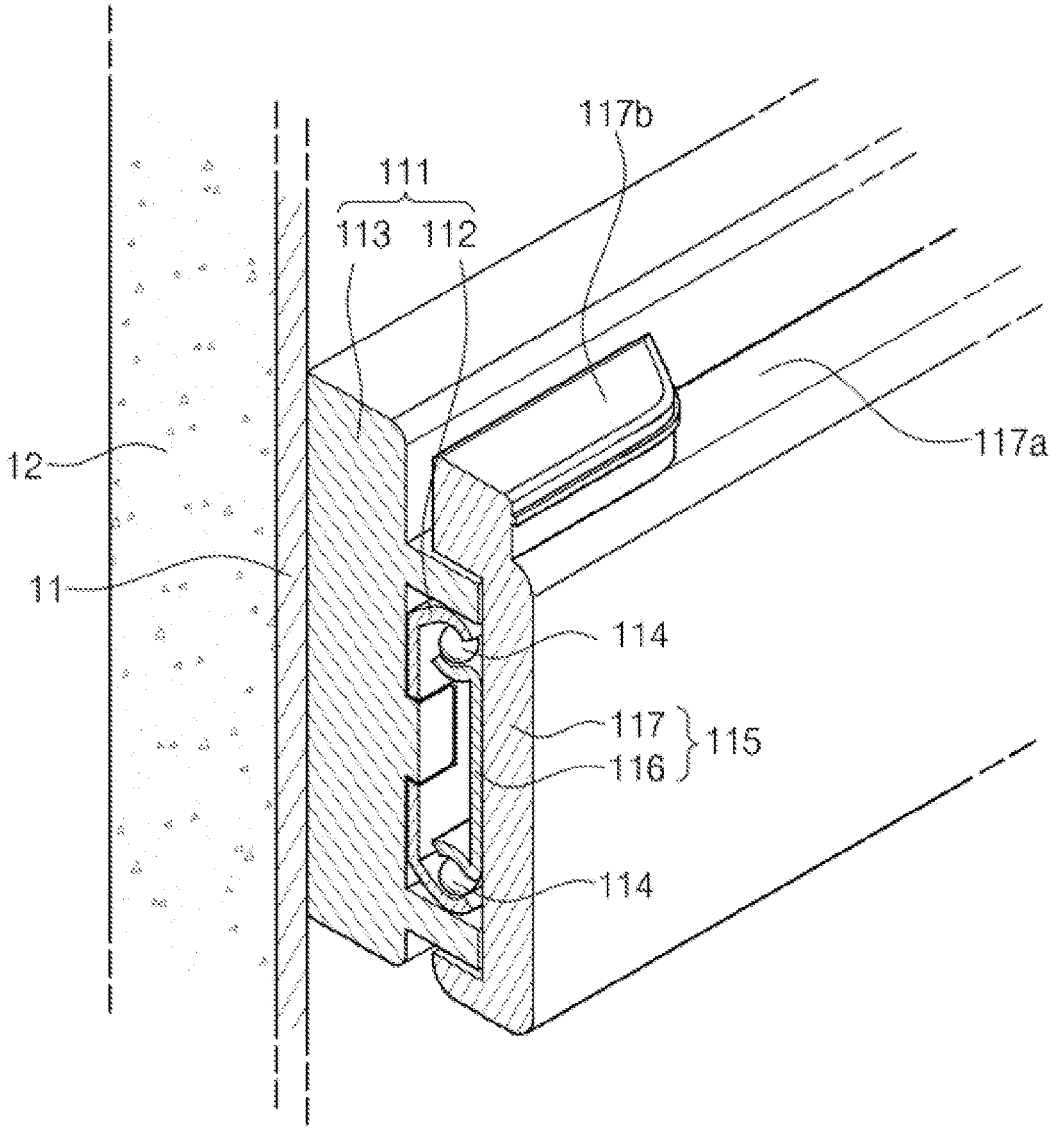
FIG. 7 is a view illustrating a left rail assembly of the refrigerator of FIG. 1.
Figure 8:
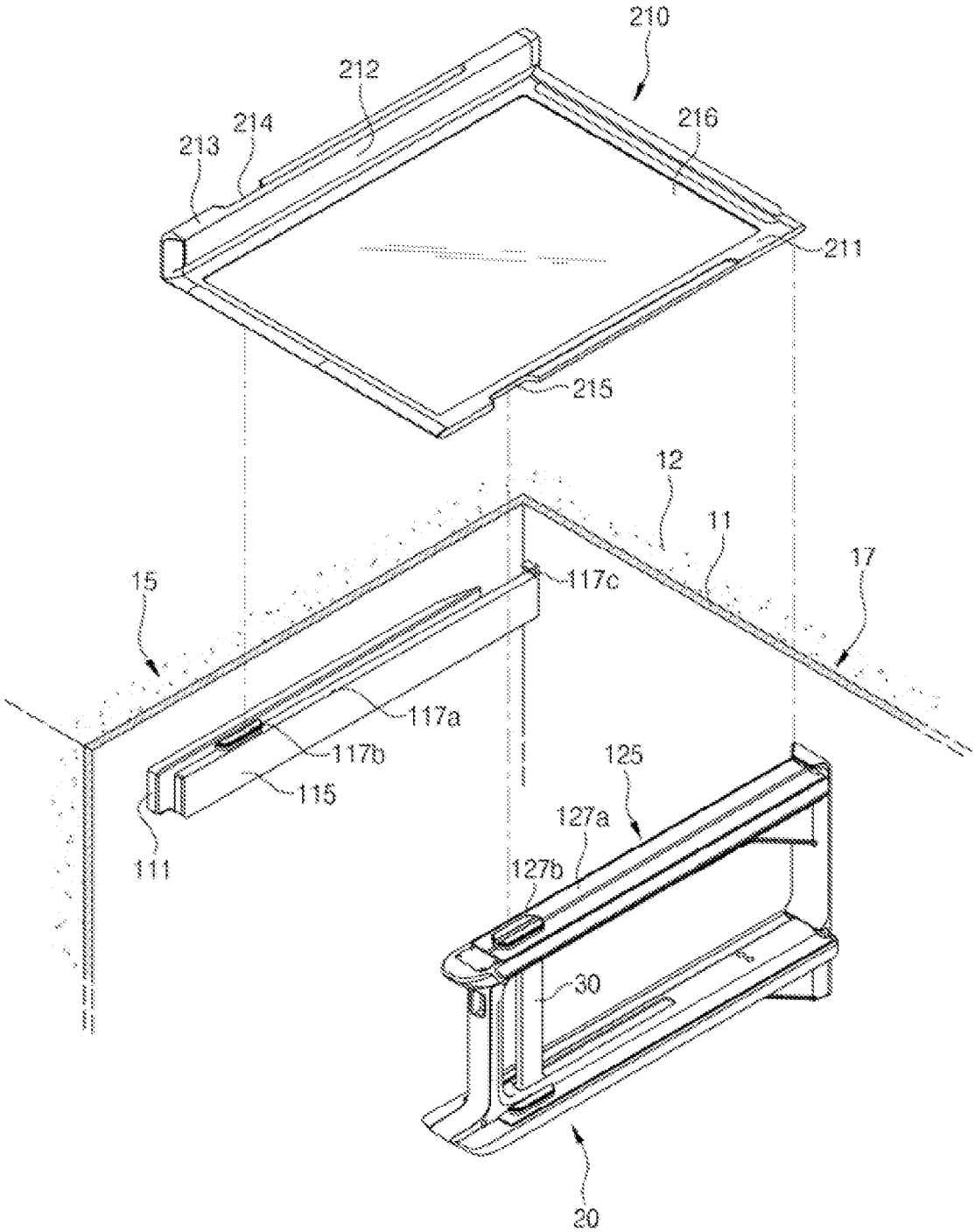
FIG. 8 is a view illustrating a configuration in which a first shelf is mounted to the center shelf support unit.

FIG. 2 is a view illustrating shelves, a left and right rail assembly for supporting the shelves, and a center shelf support unit in the refrigerator of FIG. 1, FIG. 3 is an exploded view illustrating the center shelf support unit of the refrigerator of FIG. 1, FIG. 4 is a back perspective view illustrating a center support frame of the refrigerator of FIG. 1, FIG. 5 is a cross-sectional view illustrating a configuration in which the center support frame of the refrigerator of FIG. 1 is coupled to a rear wall of a body, FIG. 6 is a cross-sectional view illustrating a connection structure of the center support frame of the refrigerator of FIG. 1, a rail assembly, and a handle assembly, FIG. 7 is a view illustrating a left rail assembly of the refrigerator of FIG. 1, and FIG. 8 is a view illustrating a configuration in which a first shelf is mounted to the center shelf support unit.

As illustrated in FIG. 2, the shelves 210, 220, 230, and 240 may be movably supported by rail assemblies 110, 120, 130, 140, 150, 160,170, and 180.

Particularly, the first shelf 210 may be supported by a first rail assembly 110 and a second rail assembly 120 to be movable forward and backward.

The second shelf 220 may be supported by a third rail assembly 130 and a fourth rail assembly 140 to be movable forward and backward.

the third shelf 230 may be supported by a fifth rail assembly 150 and a sixth rail assembly 160 to be movable forward and backward.

The fourth shelf 240 may be supported by a seventh rail assembly 170 and a eighth rail assembly 180 to be movable forward and backward.

The first rail assembly 110 and the fifth rail assembly 150 may be installed on the left side wall 15 of the body.

The fourth rail assembly 140 and the eighth rail assembly 180 may be installed on the right side wall 16 of the body.

The second rail assembly 120 and the third rail assembly 130 may be installed on the center support frame 30.

Referring to FIG. 3, a center shelf unit 20 may include a center support frame 30, and rail assemblies 120, 130, 160, and 170.

The center support frame 30 is configured to support the second rail assembly 120, the third rail assembly 130, the sixth rail assembly 160 and the seventh rail assembly 170.

The center support frame 30 may be provided in the middle of the refrigerating compartment 5 to be spaced apart from both side walls 15 and 16 of the body 10. The center support frame 30 may be coupled to the rear wall 17 of the body 10.

Referring to FIGS. 3 to 5, the center support frame 30, particularly may include a rear coupling unit 31 coupled to the rear wall 17 of the body 10, a plurality arm units 37 and 39 extended forward from the rear coupling unit 31 to support the rail assemblies 120, 130, 160, and 170, and a vertical reinforcement 41 vertically provided between the plurality of arm units 37 and 39 to strengthen a hardness of the plurality of arm units 37 and 39.

The rear coupling unit 31, the plurality of arm units 37 and 39, and the vertical reinforcement 41 may be integrally formed, or may be assembled after being formed separately.

The rear coupling unit 31 may include an adhesive support surface 36 provided to adhere to an inner surface of the rear wall 17 of the body 10. As a contact area between the adhesive support surface 36 and the rear wall 17 is wider, the coherence between the support frame 30 and the rear wall 17 may be improved.

The center support frame 30 may include locking protrusions 32, 33, 34, and 35 protruding from the adhesive support surface 36 to the backward. The locking protrusions 32, 33, 34, and 35 are inserted into locking grooves 11*a* and 11*b* formed on the rear wall of the body 10 so that the center support frame 30 may be coupled to the rear wall 17 of the body 10.

At least one locking protrusions 32 and 34 of the locking protrusions 32, 33, 34, and 35 may be formed in a shape of a hook. The locking protrusions 32 and 34, according to one embodiment of the present disclosure, may be formed in a shape of a curved down-hook, but is not limited thereto. Therefore, the locking protrusions 32 and 34 may be formed in a shape of a curved up-hook.

The plurality of arm units 37 and 39 may be extended forward from the rear coupling unit 31 to support the rail assemblies 120, 130, 160, and 170. The plurality of arm units 37 and 39 may include an upper side arm unit 37 and a lower side arm unit 39, both of which are vertically spaced apart from to each other with a certain distance. The vertical reinforcement 41 may strengthen the hardness of the arm units 37 and 39 by connecting the upper side arm unit 37 to the lower side arm unit 39. Arm unit(s) 37, 39 may comprise an angled reinforcement 38 having a height thereof being increased as the angled reinforcement goes from the front to the back of the body 10, to reinforce the strength of the arm unit(s) 37, 39.

The center support frame 30 according to one embodiment of the present disclosure may be provided to be coupled to and supported by the rear wall 17 of the body 10. However, according to the weight of food stocked on the shelves 210, 220, 230, and 240, the center support frame 30 may be additionally supported by storage boxes 7 and 8 (refer to FIG. 1) disposed on a bottom surface of the refrigerating compartment 5 or the refrigerating compartment 5. At this time, the lower side arm unit 39 of the center support frame 30 may be supported by the bottom surface of the refrigerating compartment 5 or the storage boxes 7 and 8. As illustrated in FIG. 1, the lower side arm unit 39 of the center support frame 30 is supported by the bottom surface of the refrigerating compartment 5 or the storage boxes 7 and 8.

Referring to FIGS. 3 to 6, the second rail assembly 120 and the third rail assembly 130 may be disposed on the upper side arm unit 37, and the sixth rail assembly 160 and the seventh rail assembly 170 may be disposed on the lower side arm unit 39.

The rail assemblies 120, 130, 160 and 170 may include fixed rails 121, 131, 161, and 171 fixed to the arm units 37 and 39, moving rails 125, 135, 165, and 175 movably coupled to the fixed rail 121,131, 161 and 171 to support the shelves 210, 220, 230 and 240, and balls 124 and 134 (refer to FIG. 6) provided between the fixed rails 121,131, 161 and 171, and the moving rails 125, 135, 165, and 175 to reduce the friction.

Referring to FIG. 6, the fixed rails 121 and 131 may include rail members 122 and 132, and rail covers 123 and 133 coupled to the outside of the rail members 122 and 132.

By this structure, the moving rails 125, 135, 165, and 175 are moved forward and backward in a slide manner on the fixed rails 121, 131, 161, and 171 so that the shelves 210 220, 230 and 240 disposed on the moving rails 125, 135, 165, and 175 may be moved in forward and backward in a slide manner.

Particularly, the second rail assembly 120 may include a fixed rail 121 fixed to the upper side arm unit 37 and a fixing rail 125 movably coupled to the fixed rail 121.

The third rail assembly 130 may include a fixed rail 131 fixed to the upper side arm unit 37 and a fixing rail 135 movably coupled to the fixed rail 131.

The sixth rail assembly 160 may include a fixed rail 161 fixed to the lower side arm unit 39 and a fixing rail 165 movably coupled to the fixed rail 161.

The seventh rail assembly 170 may include a fixed rail 171 fixed to the lower side arm unit 39 and a fixing rail 175 movably coupled to the fixed rail 171.

The center shelf unit 20 may further include a center support frame 30 and a handle assembly 50 configured to surround the rail assemblies 120, 130, 160, and 170.

The handle assembly 50 may be moved forward and backward in a longitudinal direction of the arm units 37 and 39. The rail assemblies 120, 130, 160 and 170 may be selectively connected to at least one of the moving rails 125, 135, 165, and 175.

When users draw or insert the handle assembly 50, at least one of the moving rails 125, 135, 165, and 175 may be withdrawn from or inserted into together with the handle assembly 50. Therefore, the at least one of the shelves 210, 220, 230 and 240 disposed on the moving rails 125, 135, 165, and 175 may be withdrawn from or inserted into.

The handle assembly 50 may be described later in detail.

Referring to FIGS. 2 to 7, a refrigerator 1 according to one embodiment of the present disclosure, may include a first rail assembly 110, a fourth assembly 140, and the fifth rail assembly 150 and a eighth rail assembly 180, all of which are installed on the left side wall and the right side wall of the body 10 to support the shelves 210, 220, 230, and 240.

The rail assemblies 110, 140, 150, and 180 may movably support the shelves 210, 220, 230, and 240 together with the rail assemblies 120, 130, 160 and 170.

The rail assemblies 110, 140, 150, and 180 may have the similar configuration, so hereinafter only the first rail assembly 110 disposed on the upper left side will be described.

As illustrated in FIG. 7, the rail assembly 110 may include a fixed rail 111 fixed to the left side wall 15 of the body 10, and a moving rail 115 movably coupled to the fixed rail 111 and a ball 114 provided between the fixed rail 111 and the moving rail 115 to reduce the friction.

The fixed rail 111 and the moving rail 115 may include rail members 112 and 116, rail covers 113 and 117 coupled to the rail member 112 and 116, respectively.

Referring to FIG. 8, a structure in which shelves 210, 220, 230 and 240 are mounted to moving rails 115, 125, 135, 145, 155, 165, 175, and 185 will be described.

Mounting structure of all moving rails 115, 125, 135, 145, 155, 165, 175, and 185 are the same. Therefore, a first shelf 210 being mounted to a first moving rail 115 and a second moving rail 125 will be described and the other will be omitted.

Moving rails 115 and 125 may include shelf support surfaces 117*a* and 127*a* and interlocking protrusions 117*b* and 127*b* protruding from the shelf support surfaces 117*a* and 127*a* to interlock the shelf 210.

The shelf 210 may include a shelf body 216 and a shelf frame 211 surrounding an edge of the shelf body 216.

At the left side or the right side of the shelf frame 211, a stepped forming portion 212 protruding vertically and a stepped portion 213 extended horizontally from the stepped forming portion 212 may be provided. That is, the stepped portion 213 may be higher or lower than other portion of the shelf 210. This is for manipulating the height of the shelf 210 according to the rotation of the shelf 210, and the description thereof will be elaborated later.

Interlocking grooves 214 and 215, which interlocking protrusions 117*b* and 127*b* of the moving rails 115 and 125 are inserted into, may be formed at the shelf frame 111. The interlocking protrusions 117*b* and 127*b* are inserted into the interlocking grooves 214 and 215 so that the moving rails 115 and 125 may be in cooperation with the movement of the shelf 210.

The interlocking protrusions 117*b* and 127*b* may be disposed on any point between a front-end and a back-end of the moving rails 115 and 125, and at the back-end of the moving rails 115 and 125, and an additional interlocking protrusion 117*c* may be provided. The additional interlocking protrusion 117*c* may make contact with the back side of the shelf 210.

When the shelf 210 is mounted to the moving rails 115 and 125, this structure allows the shelf 210 to be operated in cooperation with the moving rails 115 and 125.

Particularly, when users pull or push the shelf 210, the first moving rail 115 and the second moving rail 125, both of which support the shelf 210 may be withdrawn from or inserted into together with the shelf 210. When users pull or push the second moving rail 125, the shelf 210 and the first moving rail 115 may be withdrawn from or inserted into together the second moving rail 125.

A handle assembly 50, which is described later, may allow the shelf 210 to be withdrawn from or inserted into without grasping the shelf 210 directly by using the cooperation structure.

Figure 9:
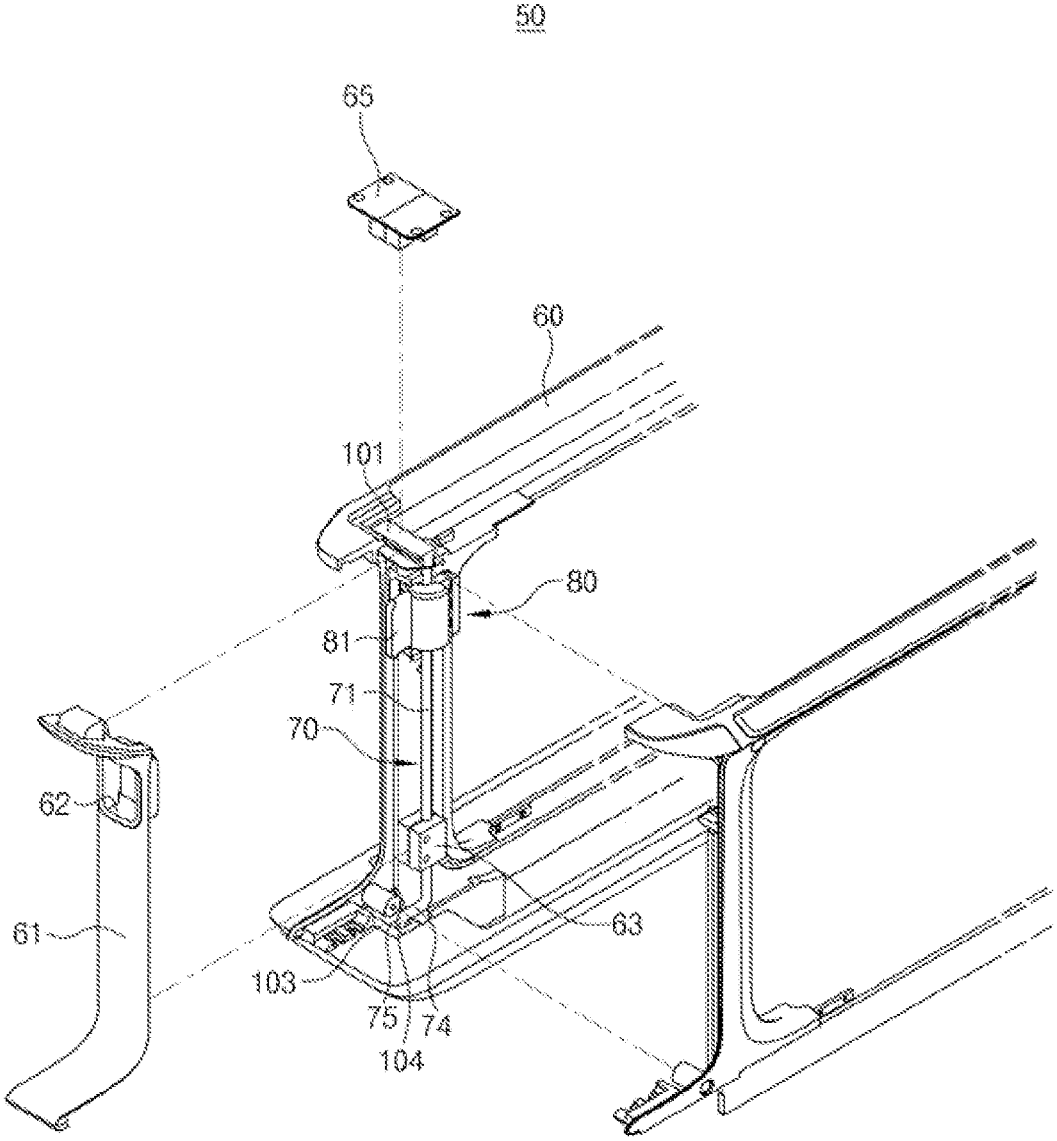
FIG. 9 is an exploded view illustrating a configuration of the handle assembly of the refrigerator of FIG. 1.
Figure 10:
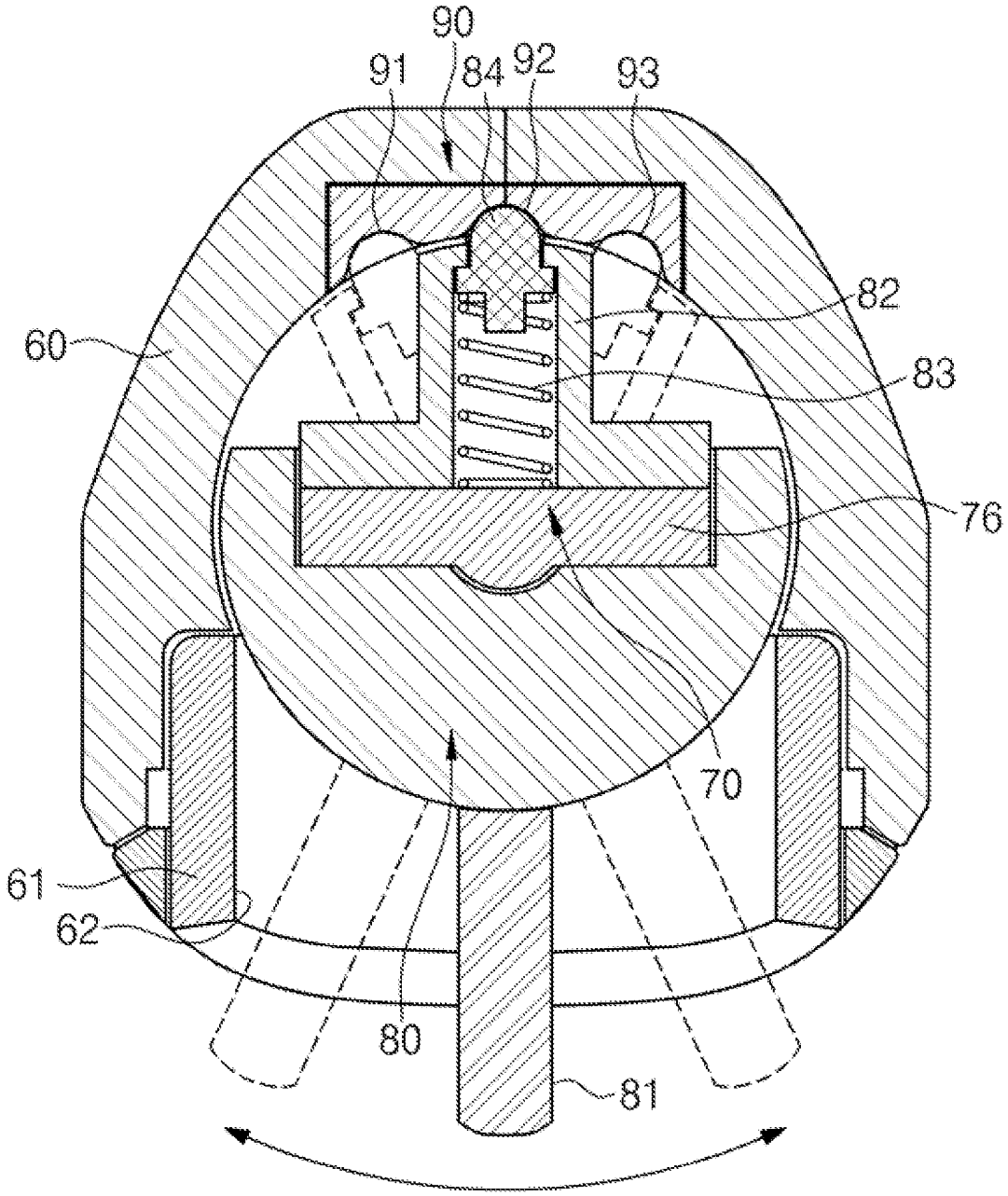
FIG. 10 is a cross-sectional view taken along one surface of a manipulation member passing through the handle assembly for illustrating a motion of the handle assembly of the refrigerator of FIG. 1.
Figure 11:
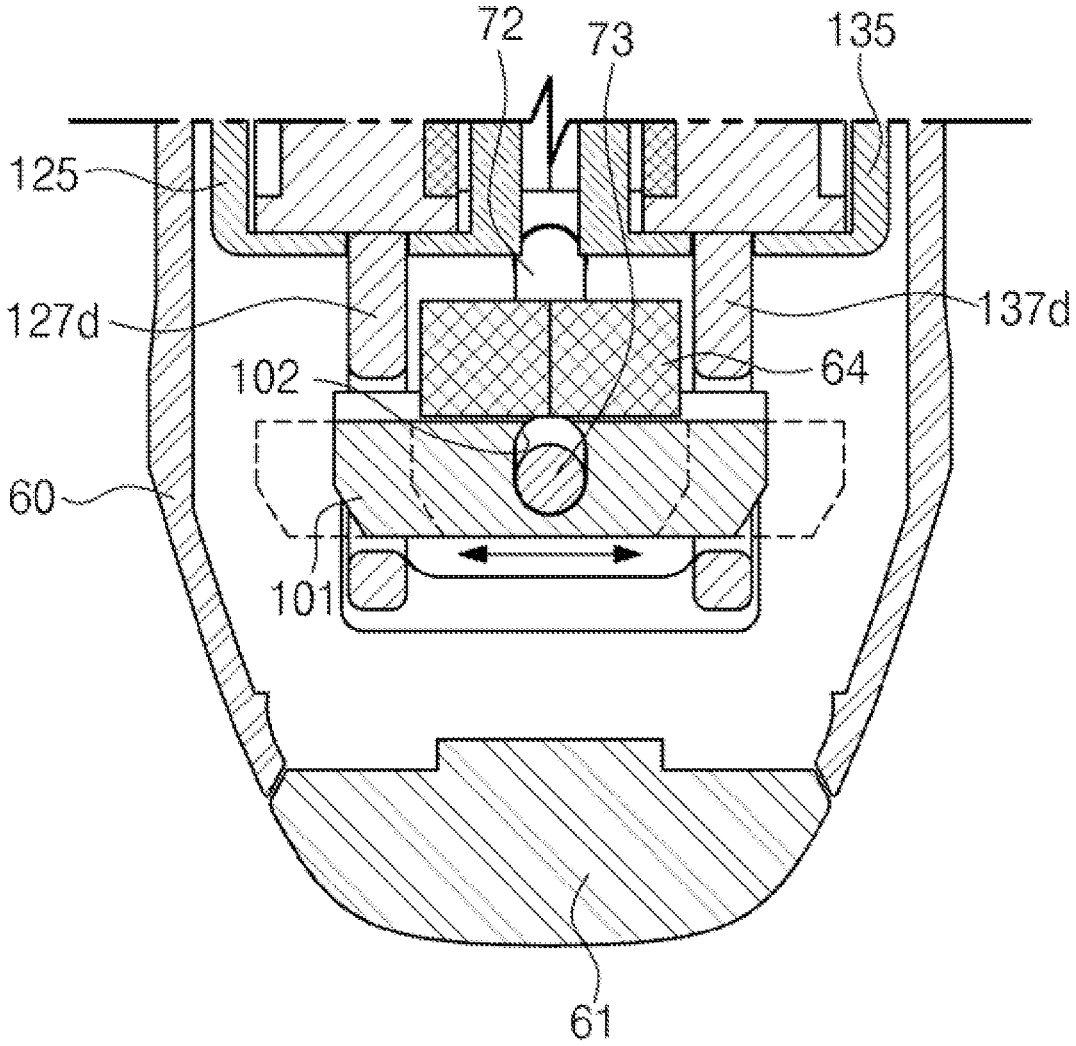
FIG. 11 is a cross-sectional view taken along one surface of an upper connection member passing through the handle assembly for illustrating a motion of the handle assembly of the refrigerator of FIG. 1.

FIG. 9 is an exploded view illustrating a configuration of the handle assembly of the refrigerator of FIG. 1, FIG. 10 is a cross-sectional view taken along one surface of a manipulation member passing through the handle assembly for illustrating a motion of the handle assembly of the refrigerator of FIG. 1, FIG. 11 is a cross-sectional view taken along one surface of an upper connection member passing through the handle assembly for illustrating a motion of the handle assembly of the refrigerator of FIG. 1, and FIGS. 12 to 14 are views illustrating a drawing motion according to a position of the manipulation member of the handle assembly of the refrigerator of FIG. 1.

Referring to FIGS. 3, 9 to 11, a handle assembly of a center shelf unit 20 of a refrigerator in accordance with one embodiment of the present disclosure will be described.

The handle assembly 50 is configured to allow users to pull and push easily the shelves 210, 220, 230 and 240 by pulling and pushing the handle assembly 50, instead, users pull and push the shelves 210, 220, 230 and 240 by grasping the shelves 210, 220, 230 and 240.

The handle assembly 50 according to one embodiment of the present disclosure may be provided the center, so that at least one of a right side shelf and a left side shelf may be withdrawn from and inserted into. That is, only the left side shelves 210 and 230 may be withdrawn from and inserted into, only the right side shelves 220 and 240 may be withdrawn from and inserted into, and the left side shelves 210, and 230, and the right side shelves 220 and 240 may be simultaneously withdrawn from and inserted into.

The handle assembly 50 may include a handle body 60 installed to be movable along arm units 37 and 39 of a center support frame 30, and a connection device configured to selectively connect the handle body 60 to at least one of rail assemblies 120, 130, 160 and 170 of the rail assemblies 120, 130, 160, and 170. A front cover 61 may be coupled to the front surface of the handle body 60.

The connection device may include a rotation member 70 rotatably provided on the handle body 60, a manipulation member 80 provided rotatably together with the rotation member 70 to operate the rotation of the rotation member 70 and connection members 101, and 103 (refer to FIGS. 3 and 11) provided on the rotation member 70 to be connected or be disconnected to connecting rings 127*d* and 137*d* (refer to FIGS. 3 and 11) provided on the moving rails 125, 135, 165, and 175.

The rotation member 70 may be a wire member having a several bent. That is, the rotation member 70 may include a rotation body 71 (refer to FIG. 9), an upper bent portion 72 (refer to FIG. 11) bent forward in the upper portion of the rotation body 71, an upper end portion 73 (refer to FIG. 11) bent forward again from the upper bent portion 72, a lower bent portion 74 (refer to FIG. 9) bent forward in the lower portion of the rotation body unit 71, and a lower end portion 75 bent forward again from the lower bent portion 74.

The rotation member 70 may be rotated with respect to the rotation body 71. That is, the rotation body 71 may be rotated in position and the other parts may be rotated with respect to the rotation body 71. A rotation member support unit 63 (refer to FIG. 9) fixed to the handle body 60 may rotatably support the rotation member 70.

The upper end portion 73 may be inserted into an inserting groove 102 (refer to FIG. 11) formed on an upper connection member 101 to transmit a force to the connection member 101, and the lower end portion 75 may be inserted into an inserting groove 104 (refer to FIG. 9) formed on a lower connection member 103 to transmit a force to the lower connection member 103.

As illustrated in FIG. 11, when the rotation member 70 is rotated with respect to the rotation body 71, the upper end portion 73 of the rotation member 70 may be rotated with respect to the rotation body 71. Therefore, the upper connection member 101 connected to the upper end portion 73 may be moved to the right side or the left side.

At this time, a connection member guide unit 64 (refer to FIG. 11) provided on the handle body 60 may guide the upper connection member 101 so that a motion of the upper connection member 101 become a linear motion. An upper cover 65 (refer to FIG. 9) may be coupled to an upper portion of the handle body 60 to support the upper connection member 101.

According to the position of the upper connection member 101, the upper connection member 101 may be connected to only a connecting ring 127*d* of the moving rail 125 of the second rail assembly 120 (refer to FIGS. 3 and 11), may be connected to only a connecting ring 137*d* of the moving rail 135 of the third rail assembly 130 (refer to FIGS. 3 and 11) or may be connected to the both.

Even the description is omitted, the lower connection member 103 may be connected to a connecting ring of the moving rail 165 of the sixth rail assembly 160, may be connected to a connecting ring of the moving rail 175 of the sixth rail assembly 170, or may be connected to the both according to the position of the lower connection member 103.

As illustrated in FIG. 10, the handle assembly 50 may further include a fixing protrusion 84 movably provided on the manipulation member 80 to fix the position of the rotation member 70, a fixing member 90 having at least one fixing grooves 91, 92, and 93 into which the fixing protrusion 84 is inserted, and an elastic member 83 to allow the fixing protrusion 84 to be elastically fixed to one of the fixing grooves 91, 92 and 93.

The rotation member 70 is fixedly coupled to the manipulation member 80 so that the rotation member 70 may be rotated by rotating the manipulation member 80.

The manipulation member 80 may include a manipulation knob 81 protruding for users to rotate the manipulation member 80, and an elastic member installation unit 82 in which the elastic member is installed. The manipulation knob 81 may be exposed toward the outside through an opening 61 of the front cover 62. The elastic member installation unit 82 may protrude in a protruding direction of the manipulation knob 81 and in an opposite direction thereof with respect to the rotation member 70.

In one embodiment of the present disclosure, the fixing member 90 may include three fixing grooves 91, 92 and 93. When the fixing protrusion 84 is inserted into one of the fixing grooves 91, 92 and 93 so that the rotation member 70 may be fixed as long as an external force is not applied.

The fixing grooves 91, 92 and 93 may include a first fixing groove 91, a second fixing groove 92, and a third fixing groove 93.

As illustrated above, the elastic member installation unit 82 protrudes in a protruding direction of the manipulation knob 81 and an opposite direction thereof with respect to the rotation member 70. Therefore, if the manipulation knob 81 is rotated to the left side when viewing from the front, the fixing protrusion 84 is fixed to the third fixing groove 93, the rotation member 70 is rotated clockwise on the basis of FIG. 10, and the first connection member 101 may be connected to the moving rail 125 of the second rail assembly 120.

If the manipulation knob 81 is rotated to the right side when viewing from the front, the fixing protrusion 84 is fixed to the first fixing groove 91, the rotation member 70 is rotated counter clockwise on the basis of FIG. 10, and the first connection member 101 may be connected to the moving rail 135 of the third rail assembly 130.

If the manipulation knob 81 is placed on the center, the fixing protrusion 84 is fixed to the second fixing groove 92, and the first connection member 101 may be connected to simultaneously the moving rail 125 of the second rail assembly 120 and the moving rail 135 of the third rail assembly 130.

As illustrated above, in one embodiment of the present disclosure, the upper end portion 73 of the rotation member 70 may connected to the upper connection unit 101, and the lower end portion 75 of the rotation member 70 may connected to the lower connection unit 103. The connection between the lower connection unit 103 and the sixth rail assembly 160, or the seventh rail assembly 170 may be the same as that of the upper connection unit 101 and the second rail assembly 120 or the third rail assembly 130.

Figure 12:
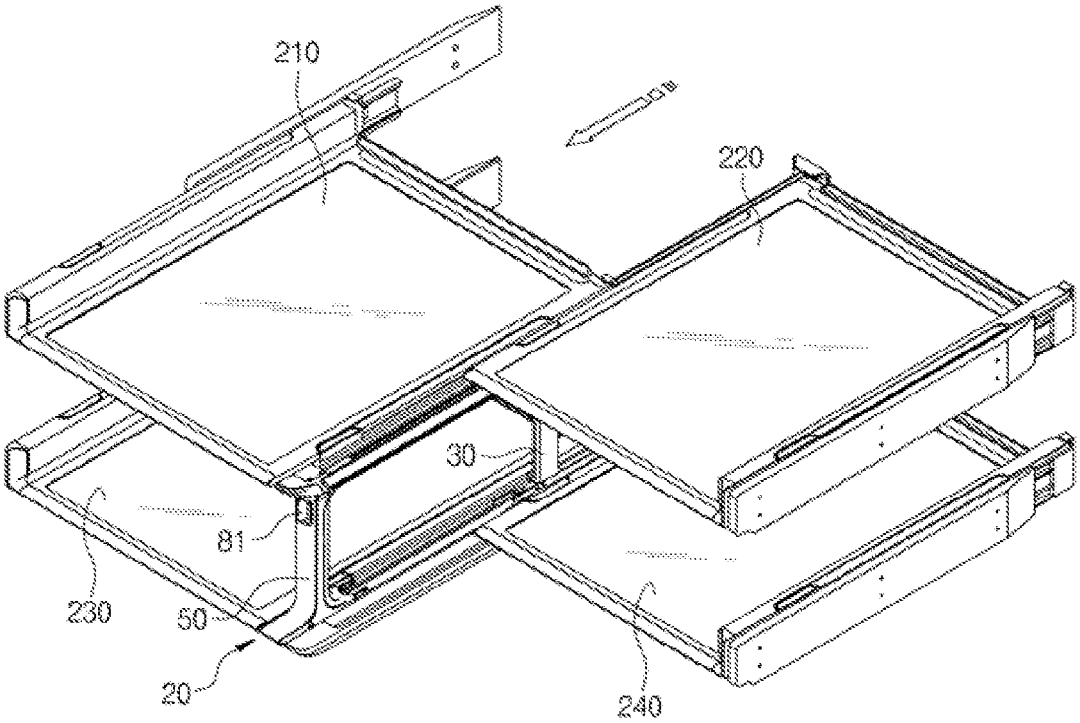
FIGS. 12 to 14 are views illustrating a drawing motion of shelves according to a position of the manipulation member of the handle assembly of the refrigerator of FIG. 1.

That is, when the manipulation knob 81 is placed at the left side, and the handle assembly 50 is withdrawn from or inserted into, as illustrated in FIG. 12, the upper left first shelf 210 together with the lower left third shelf 230 may be withdrawn from and inserted into.

Figure 13:
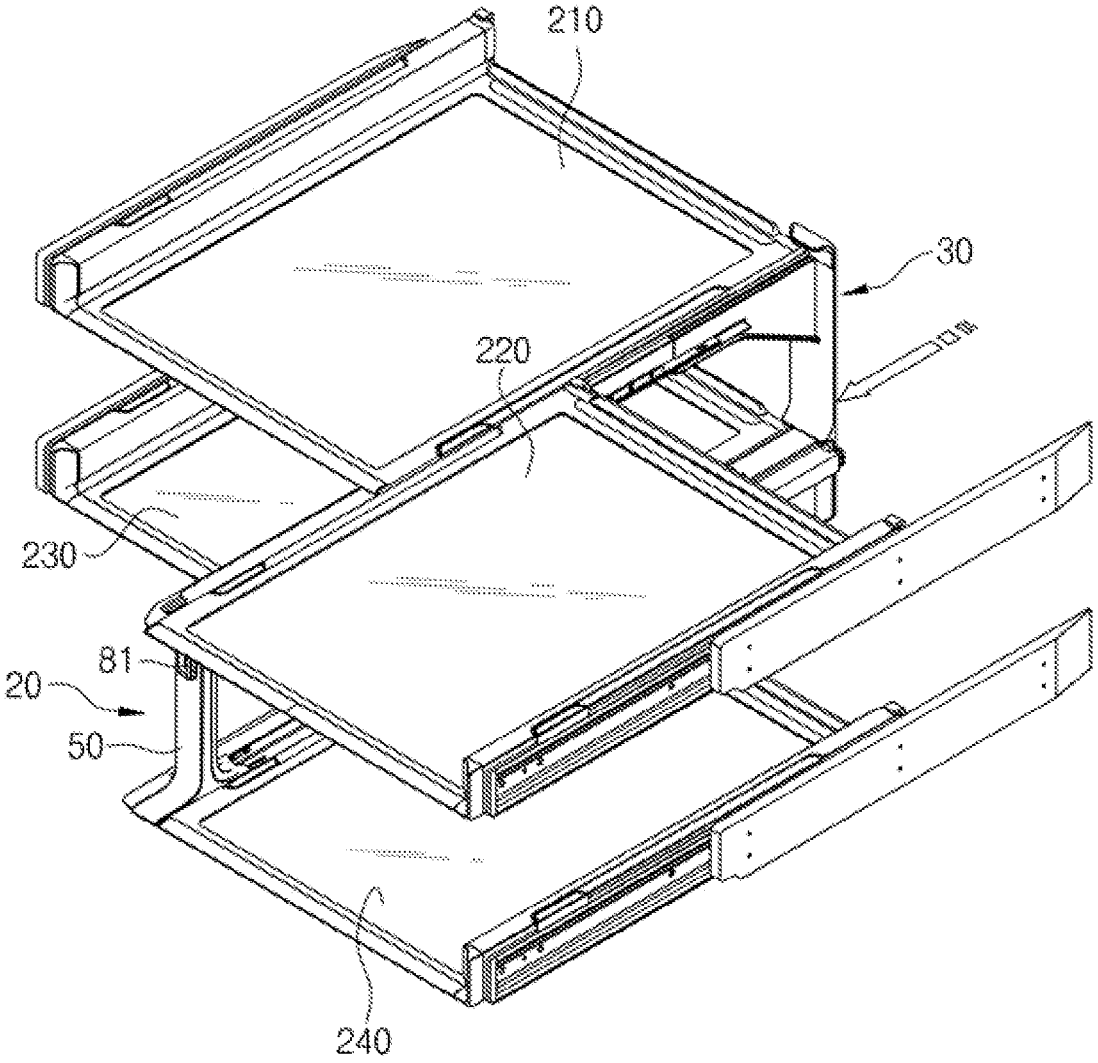

As illustrated in FIG. 13, when the manipulation knob 81 is placed at the right side, and the handle assembly 50 is withdrawn from or inserted into, the upper right second shelf 220 together with the lower right fourth shelf 240 may be withdrawn from and inserted into.

Figure 14:
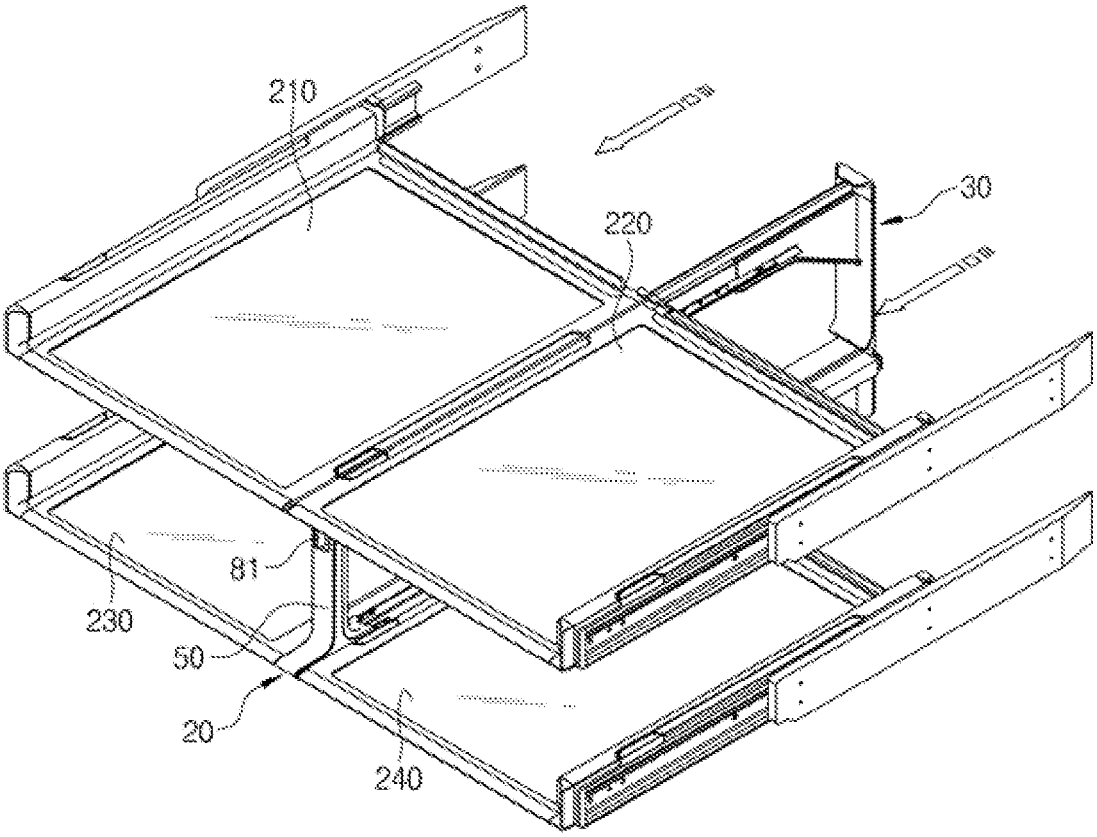

As illustrated in FIG. 14, when the manipulation knob 81 is placed at the center and the handle assembly 50 is withdrawn from or inserted into, all shelves 210, 220, 230 and 240 may be withdrawn from and inserted into.

Figure 15:
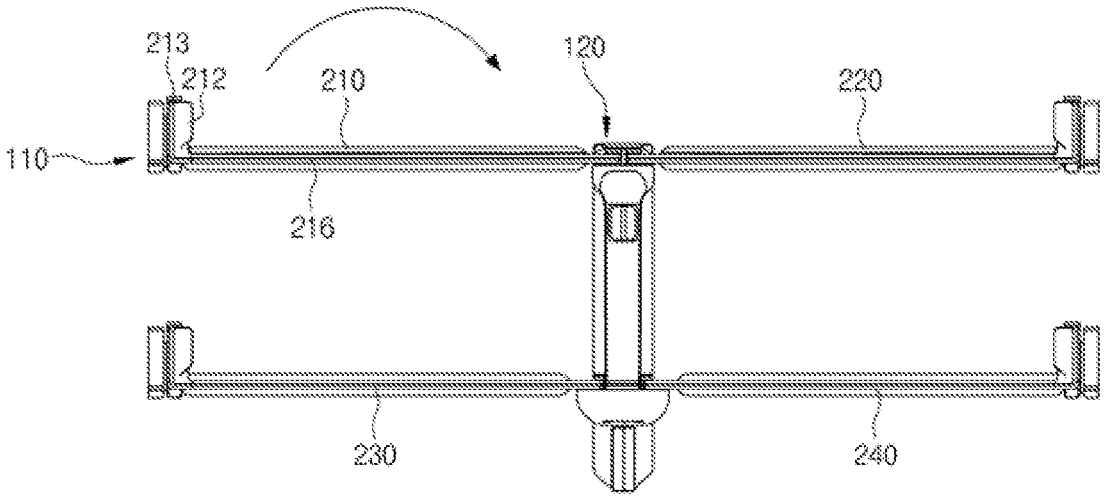
FIGS. 15 to 16 are views illustrating a motion of adjusting a height of the shelf by the rotation of the shelf of the refrigerator of FIG. 1.
Figure 16:
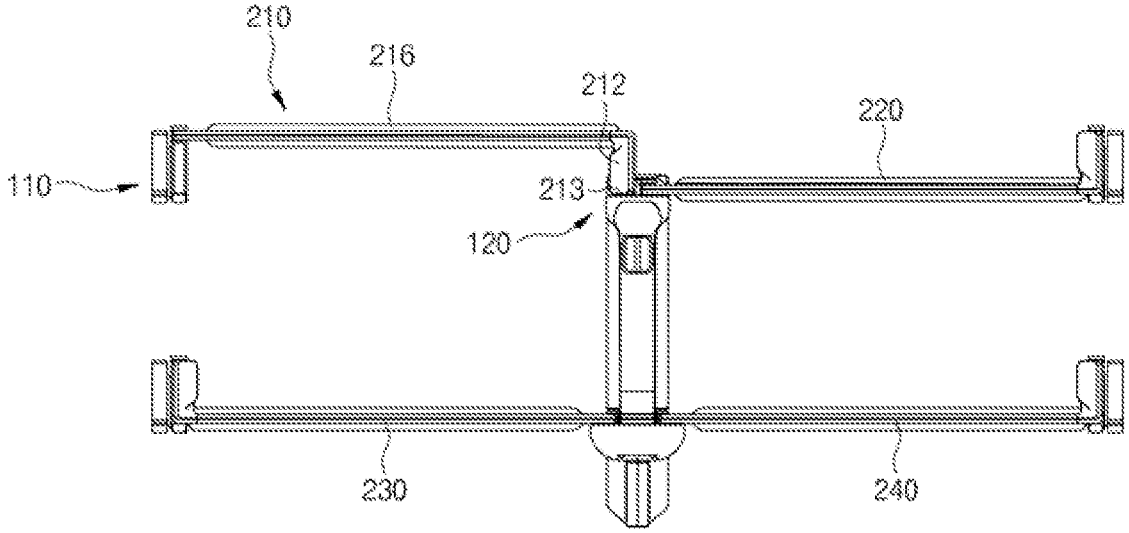

FIGS. 15 to 16 are views illustrating a motion of adjusting a height of the shelf by the rotation of the shelf of the refrigerator of FIG. 1.

As illustrated above, at the left side or the right side of the shelf frame 211, a stepped forming portion 212 (refer to FIG. 8) protruding vertically and a stepped portion 213 extended horizontally from the stepped forming portion 212 (refer to FIG. 8) may be provided. As illustrated FIGS. 15 and 16, when the shelf 210 is rotated in 180 degree, the shelf 210 is upside down so that the height of the shelf 210 may be changed.

The height difference between the shelf support surface 117*a* (refer to FIG. 8) of the first rail assembly 110 and the shelf support surface 127*a* (refer to FIG. 8) of the second rail assembly 120, both of which support the shelf 210 from the both sides, is the same as the height of the stepped forming portion 212 of the shelf 210 so that the shelf 210 may be placed in parallel in an any case, such as the shelf 210 is paced in right position, or in a reversed position.

As is apparent from the above description, according to the proposed shelf of the refrigerator, the convenience of the user may be improved since the shelf is disposed in a right side and a left side of the refrigerator, respectively, and capable of moving forward and backward in slide manner, and of changing the height thereof.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment formed inside the body;

a plurality of shelves provided in the storage compartment;

a center frame provided spaced apart from both side was of the storage compartment, the center frame comprising:

a rear coupling unit supported at a rear wall of the storage compartment, and a plurality of arm units extended forward from the rear coupling unit, the plurality of arm units vertically spaced apart from each other by a distance, the arm units supporting at least a pair of the plurality of shelves; and first rail assemblies disposed respectively at the both side was of the storage compartment and second rail assemblies disposed on the plurality of arm units of the center frame, the first and second rail assemblies support movement of one or a combination of the shelves on the arm units in a forward and backward sliding manner, wherein the center frame further comprises a handle assembly installed on the arm units of the center frame, the handle assembly comprising a handle body installed to be movable along the arm units, and a connection device connecting the handle body to one or a combination of the second rail assemblies to slide the one or the combination of the shelves on the arm units forward and backward on the one or the combination of the second rail assemblies, and the connection device comprises a rotation member rotatably provided on the handle body, a manipulation member rotating the rotation member, and a connection member coupled to the rotation member for a linear motion thereof in conjunction with a rotary motion of the rotation member for connection or disconnection to the one or the combination of the second rail assemblies.

2. The refrigerator of claim 1, wherein at least one of the arm units comprises an angled reinforcement having a height thereof increased as the angled reinforcement extends from a front of the storage compartment to a back of the storage compartment, to reinforce a strength of the at least one of the arm units; and/or the plurality of arm units comprise a vertical reinforcement connecting the plurality of arm units to each other to further reinforce a strength of the plurality of arm units.

3. The refrigerator of claim 1, wherein the rear coupling unit comprises an adhesive support surface adhering to an inner surface at the rear wall of the storage compartment to strengthen coherence of the center support frame at the rear wall of the storage compartment.

4. The refrigerator of claim 1, wherein the center frame further comprises at least one locking protrusion protruding to be coupled at the rear wall of the storage compartment.

5. The refrigerator of claim 4, wherein the rear wall of the storage compartment comprises at least one locking groove to allow the at least one locking protrusion to be inserted into.

6. The refrigerator of claim 4, wherein at least one of the at least one locking protrusion is formed in a shape of a hook.

7. The refrigerator of claim 1, wherein a stepped forming portion protrudes vertically and a stepped portion extends horizontally from the stepped forming portion at a side of at least one of the plurality of shelves, thereby a height of the at least one of the plurality of shelves adjustable by reversing the at least one of the plurality of shelves.

8. The refrigerator of claim 1, wherein at least one rail assembly of the first and second rail assemblies comprises a fixed rail and a moving rail movably coupled to the fixed rail to support a corresponding one of the plurality of shelves.

9. The refrigerator of claim 8, wherein the moving rail comprises a shelf support surface supporting the corresponding one of the plurality of shelves, and an interlocking protrusion protruding to interlock the corresponding one of the plurality of shelves.

10. The refrigerator of claim 9, wherein the corresponding on of the plurality of shelves comprises an interlocking groove in conjunction with the interlocking protrusion.

11. The refrigerator of claim 1, wherein the handle assembly further comprises a fixing protrusion movably installed on the manipulation member to fix a position of the rotation member, a fixing member provided with at least one fixing groove into which the fixing protrusion is inserted, and an elastic member elastically supporting the fixing protrusion toward the at least one fixing groove.

12. The refrigerator of claim 1, wherein a moving rail of at least one of the first and second rail assemblies comprises a connecting ring in which the connection device is inserted into and connected for connection between the connection device and the at least one of the first and second rail assemblies.

13. A refrigerator comprising:

a body with a left side wall and a right side wall, a first rail assembly provided on the left side wall of the body, a center frame disposed in a longitudinal direction and spaced apart from the left and right side walls of the body, the center frame comprising:

a rear coupling unit supported at a rear wall of the body, and at least two arm units extended forward from the rear coupling unit and vertically spaced apart from each other;

a second rail assembly and a third rail assembly disposed on the at least two arm units of the center frame, a fourth rail assembly provided on the right side wall of the body, a first shelf movably supported by the first and the second rail assemblies, and a second shelf movably supported by the third and the fourth rail assemblies, wherein the first second, third, and fourth rail assemblies support movement of the first shelf and the second shelf in a forward and backward sliding manner, wherein the center frame further comprises a handle assembly installed on the arm units of the center frame, the handle assembly comprising a handle body installed to be movable along the arm units, and a connection device connecting the handle bode to the second rail assembly and/or the third rail assembly to slide the first shelf and/or the second shelf forward and backward on the second rail assembly and/or the third rail assembly, and the connection device comprises a rotation member rotatably provided on the handle body, a manipulation member rotating the rotation member, and a connection member coupled to the rotation member for a linear motion thereof in conjunction with a rotary motion of the rotation member for connection or disconnection to the second rail assembly and/or the third rail assembly.

14. A refrigerator comprising:

a body, a storage compartment formed inside the body, at least two shelves provided in the storage compartment, and a center shelf support unit provided in a longitudinal direction to be spaced apart from left and right side walls of the storage compartment and supporting the at least two shelves, the center shelf support unit comprising:

a rear coupling unit supported at a rear wall of the storage compartment, and a plurality of arm units extended forward from the rear coupling unit and vertically spaced apart from each other and supporting at least two rail assemblies, the plurality of arm units and the at least two rail assemblies supporting the at least two shelves on left or right sides of the center shelf support unit, wherein the center shelf support unit further comprises a handle assembly which selectively connects to at least one of the at least two rail assemblies on the arm units of the center shelf support unit to control withdrawal or insertion of one or a combination of the at least two shelves relative the storage compartment on the at least one of the at least two rail assemblies, the handle assembly comprising a handle body installed to be movable along the arm units, and a connection device connecting the handle body to the at least one of the at least two rail assemblies to slide the one or the combination of the at least two shelves forward and backward on the at least one of the at least two rail assemblies, and the connection device comprises a rotation member rotatably provided on the handle body, a manipulation member rotating the rotation member, and a connection member coupled to the rotation member for a linear motion thereof in con unction with a rotary motion of the rotation member for connection or disconnection to the at least one of the at least two rail assemblies.

* * * * *